US011499316B2

(12) United States Patent
Svec et al.

(10) Patent No.: US 11,499,316 B2
(45) Date of Patent: Nov. 15, 2022

(54) ROOFING MATERIAL WITH PATTERNED ADHESIVE

(71) Applicant: BMIC LLC, Dallas, TX (US)

(72) Inventors: James A. Svec, Kearny, NJ (US); Li-Ying Yang, Whippany, NJ (US); Daniel E. Boss, Morris Township, NJ (US)

(73) Assignee: BMIC LLC, Dallas, TX (US)

( * ) Notice: Subject to any disclaimer, the term of this patent is extended or adjusted under 35 U.S.C. 154(b) by 0 days.

(21) Appl. No.: 17/592,961

(22) Filed: Feb. 4, 2022

(65) Prior Publication Data

US 2022/0251843 A1 Aug. 11, 2022

Related U.S. Application Data

(60) Provisional application No. 63/146,295, filed on Feb. 5, 2021.

(51) Int. Cl.

| | |
|---|---|
| ***E04D 1/34*** | (2006.01) |
| ***E04D 1/20*** | (2006.01) |
| *E04D 1/00* | (2006.01) |

(52) U.S. Cl.

CPC ..... *E04D 1/34* (2013.01); *E04D 1/20* (2013.01); *E04D 2001/005* (2013.01); *E04D 2001/3423* (2013.01); *E04D 2001/3435* (2013.01); *E04D 2001/3491* (2013.01)

(58) Field of Classification Search

CPC ..... E04D 1/34; E04D 1/20; E04D 2001/005; E04D 2001/3423; E04D 2001/3435; E04D 2001/3491

See application file for complete search history.

(56) References Cited

U.S. PATENT DOCUMENTS

| | | | | |
|---|---|---|---|---|
| 4,824,880 | A * | 4/1989 | Algrim | E04D 1/29 524/68 |
| 5,239,802 | A * | 8/1993 | Robinson | E04D 1/26 52/553 |
| 6,360,506 | B1 * | 3/2002 | Graae | D06N 5/00 52/552 |
| 6,494,010 | B1 * | 12/2002 | Brandon | E04D 1/20 52/518 |
| 8,800,477 | B2 | 8/2014 | Crane et al. | |
| 9,498,792 | B2 | 11/2016 | Miller et al. | |
| 10,189,656 | B2 | 1/2019 | Belt et al. | |

(Continued)

*Primary Examiner* — Adriana Figueroa

(74) *Attorney, Agent, or Firm* — Greenberg Traurig, LLP

(57) ABSTRACT

Some embodiments of the present disclosure relate to a roofing system. In some embodiments, the roofing system includes a first roofing material, wherein the first roofing material comprises a top surface and a bottom surface. In some embodiments, the top surface of the first roofing material comprises a nail zone with a plurality of fines. In some embodiments, the roofing system includes a second roofing material, wherein the second roofing material comprises a top surface and a bottom surface. In some embodiments, the bottom surface of the second roofing material comprises a plurality of fines. In some embodiments, the roofing system comprises and a patterned adhesive, which directly contacts at least a portion of the plurality of fines in the nail zone and at least a portion of the plurality of fines on the bottom surface of the second roofing material.

21 Claims, 3 Drawing Sheets

(56) References Cited

U.S. PATENT DOCUMENTS

| | | | | |
|---|---|---|---|---|
| 10,434,538 | B2 | 10/2019 | Calaman et al. | |
| 10,947,729 | B2 * | 3/2021 | Collins | E04D 1/20 |
| 11,155,996 | B2 * | 10/2021 | Dicorcia | E04D 1/26 |
| 2005/0202216 | A1 * | 9/2005 | Rodrigues | E04D 1/26<br>428/194 |
| 2005/0210806 | A1 * | 9/2005 | Guerra | E04D 1/265<br>52/518 |
| 2009/0139175 | A1 * | 6/2009 | Todd | E04D 1/26<br>52/557 |
| 2011/0283646 | A1 * | 11/2011 | Vermilion | E04D 1/26<br>52/539 |
| 2013/0025225 | A1 * | 1/2013 | Vermilion | E04D 1/26<br>52/518 |
| 2013/0042561 | A1 * | 2/2013 | Kalkanoglu | E04D 13/16<br>427/188 |
| 2014/0272244 | A1 * | 9/2014 | Harrington, Jr. | E04D 1/28<br>428/57 |
| 2017/0321423 | A1 * | 11/2017 | Aschenbeck | E04D 1/26 |
| 2020/0040582 | A1 | 2/2020 | Boss et al. | |
| 2020/0199874 | A1 * | 6/2020 | Haynes | E04D 1/26 |
| 2020/0248456 | A1 * | 8/2020 | Click | E04D 1/20 |
| 2021/0180325 | A1 * | 6/2021 | Simon | B32B 5/16 |

* cited by examiner

ROOFING MATERIAL WITH PATTERNED ADHESIVE

CROSS-REFERENCE TO RELATED APPLICATIONS

This application claims priority to U.S. Provisional Application 63/146,295, filed on Feb. 5, 2021 and entitled "Roofing Material with Patterned Adhesive," which is incorporated herein by reference in its entirety.

FIELD

The present disclosure relates to roofing materials with patterned adhesives and methods for applying the patterned adhesives.

BACKGROUND

Traditional roofing materials have adhesives for attaching the roofing materials to other roofing materials and/or roofing substrates. Adhesives are typically applied to a roofing material in a two-step process. First, the roofing material may be manufactured in a factory. Then an adhesive may be applied to the back of the roofing membrane. After the adhesive cures, the roofing material may be adhered to another roofing material and/or to a roofing substrate.

SUMMARY

Covered embodiments are defined by the claims, not this summary. This summary is a high-level overview of various aspects and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification, any or all drawings, and each claim.

Some embodiments of the present disclosure are directed to a roofing system comprising a first roofing material comprising a top surface, wherein the top surface of the first roofing material comprises a nail zone, and wherein the nail zone comprises a plurality of fines; a second roofing material comprising a bottom surface, wherein the bottom surface of the second roofing material comprises a plurality of fines; and a patterned adhesive, wherein the patterned adhesive directly contacts at least a portion of the plurality of fines on the bottom surface of the second roofing material, and at least a portion of the plurality of fines in the nail zone on the top surface of the first roofing material.

In some embodiments, the roofing system further comprises a roof deck, the first roofing material further comprises a bottom surface, and the bottom surface of the first roofing material is secured to the roof deck.

In some embodiments, the bottom surface of the first roofing material is secured to the roof deck using an adhesive, a fastener, or any combination thereof.

In some embodiments, the nail zone comprises at least one fastener.

In some embodiments, the at least one fastener comprises a nail, and wherein the at least one nail comprises a nail head.

In some embodiments, the patterned adhesive overlaps the nail head of the at least one nail to secure the nail head in the nail zone.

In some embodiments, the first roofing material comprises a shingle, and wherein the second roofing material comprises a shingle.

In some embodiments, the patterned adhesive comprises a fiberized adhesive.

In some embodiments, the patterned adhesive includes a length and a width, the nail zone includes a length and a width, and the width of nail zone is greater than the width of the patterned adhesive.

In some embodiments, the width of the patterned adhesive is from 0.25" to 2".

Some embodiments of the present disclosure are directed to a roofing system comprising a first roofing material comprising a top surface, wherein the top surface of the first roofing material comprises a nail zone, and wherein the nail zone comprises a plurality of fines, and wherein the nail zone comprises at least one fastener, wherein the at least one fastener comprises a top portion; a second roofing material comprising a bottom surface, wherein the bottom surface of the second roofing material comprises a plurality of fines; and a patterned adhesive, wherein the patterned adhesive directly contacts at least a portion of the plurality of fines on the bottom surface of the second roofing material, and at least a portion of the plurality of fines in the nail zone on the top surface of the first roofing material, and wherein the patterned adhesive overlaps the top portion of the at least one fastener to secure the top portion of the at least one fastener in the nail zone.

In some embodiments, the at least one fastener comprises a nail, and wherein the top portion of the at least one fastener comprises a nail head.

In some embodiments, the patterned adhesive is a fiberized adhesive.

In some embodiments, the patterned adhesive includes a length and a width, \the nail zone includes a length and a width, and the width of nail zone is greater than the width of the patterned adhesive.

In some embodiments, the roofing system further comprises a roof deck, the first roofing material further comprises a bottom surface, and the bottom surface of the first roofing material is secured to the roof deck.

Some embodiments of the present disclosure are directed to a method comprising obtaining a first roofing material comprising a top surface, wherein the top surface of the first roofing material comprises a nail zone, and wherein the nail zone comprises a plurality of fines, and obtaining a second roofing material comprising a bottom surface, wherein the bottom surface of the second roofing material comprises a plurality of fines; and a patterned adhesive, wherein the patterned adhesive directly contacts the at least a portion of the plurality of fines on the bottom surface of the second roofing material, and attaching the bottom surface of the second roofing material to the top surface of the first roofing material so that the patterned adhesive directly contacts at least a portion of the plurality of fines in the nail zone on the top surface of the roofing material.

In some embodiments, the first roofing material comprises a bottom surface, and wherein the method comprises attaching the bottom surface of the first roofing material to a roof deck.

In some embodiments, attaching the bottom surface of the first roofing material to the roof deck comprises inserting at least one fastener into the nail zone on the top surface of the first roofing material.

In some embodiments, the at least one fastener is a nail comprising a nail head, and attaching the bottom surface of the second roofing material to the top surface of the first roofing material comprises positioning patterned adhesive over the nail head so as to secure the nail head in the nail zone.

In some embodiments, the patterned adhesive is a fiberized adhesive.

DRAWINGS

Some embodiments of the disclosure are herein described, by way of example only, with reference to the accompanying drawings. With specific reference now to the drawings in detail, it is stressed that the embodiments shown are by way of example and for purposes of illustrative discussion of embodiments of the disclosure. In this regard, the description taken with the drawings makes apparent to those skilled in the art how embodiments of the disclosure may be practiced.

DETAILED DESCRIPTION

Figure 1:
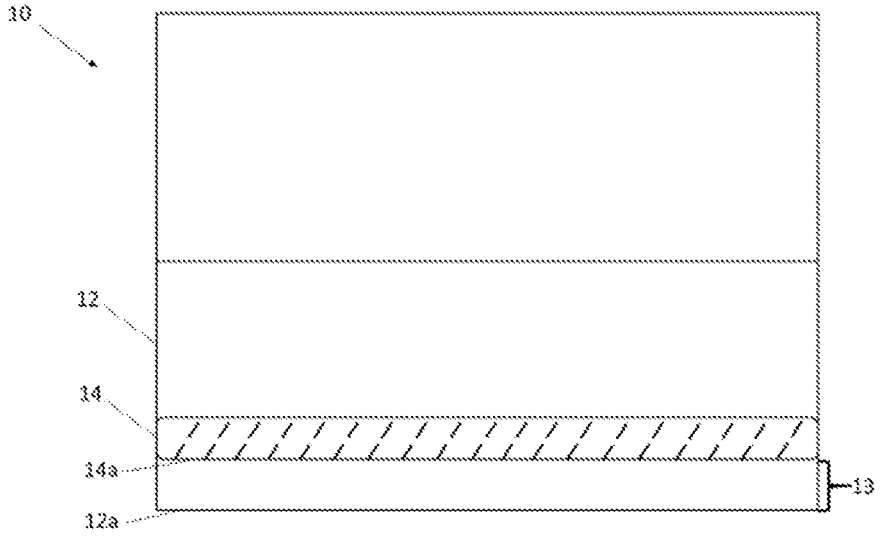
FIG. 1 is a plane view of the back surface of an exemplary embodiment of a roofing material according to the present disclosure.

Among those benefits and improvements that have been disclosed other objects and advantages of this disclosure will become apparent from the following description taken in conjunction with the accompanying figures. Detailed embodiments of the present disclosure are disclosed herein; however, it is to be understood that the disclosed embodiments are merely illustrative of the disclosure that may be embodied in various forms. In addition, each of the examples given regarding the various embodiments of the disclosure which are intended to be illustrative, and not restrictive.

Throughout the specification and claims, the following terms take the meanings explicitly associated herein, unless the context clearly dictates otherwise. The phrases "in one embodiment," "in an embodiment," and "in some embodiments" as used herein do not necessarily refer to the same embodiment(s), though it may. Furthermore, the phrases "in another embodiment" and "in some other embodiments" as used herein do not necessarily refer to a different embodiment, although it may. All embodiments of the disclosure are intended to be combinable without departing from the scope or spirit of the disclosure.

As used herein, the term "based on" is not exclusive and allows for being based on additional factors not described, unless the context clearly dictates otherwise. In addition, throughout the specification, the meaning of "a," "an," and "the" include plural references. The meaning of "in" includes "in" and "on."

As used herein, terms such as "comprising" "including," and "having" do not limit the scope of a specific claim to the materials or steps recited by the claim.

As used herein, the term "consisting essentially of" limits the scope of a specific claim to the specified materials or steps and those that do not materially affect the basic and novel characteristic or characteristics of the specific claim.

As used herein, terms such as "consisting of" and "composed of" limit the scope of a specific claim to the materials and steps recited by the claim.

As used herein, the term "fines" means small pieces of ground material. In some embodiments, the small pieces of material may include material for being deposited onto a surface of a roofing material, including mica flakes, copper slag, coal slag, sand, talc, expanded clay, slate flour, powdered limestone, silica dust, or any combination thereof.

As used herein, the term "nail zone" means a visually indicated area on a top surface of a roofing material where fasteners, including nails and/or staples, may be placed. In some embodiments, the nail zone does not have a reinforcing material, including for example, a reinforcing tape.

As used herein, the term "patterned adhesive," means an adhesive having a repeated design. In some embodiments, the repeated design may include swirls, spirals, stripes, dashes, sine waves, lines, stripes or any combination or randomized combination thereof.

As used herein, the term "fiberized adhesive" means an adhesive that has been sprayed and/or aerosolized so as to form fiberized strands.

All prior patents, publications, and test methods referenced herein are incorporated by reference in their entireties.

Some embodiments of the present disclosure relate to a roofing system. In some embodiments, the roofing system includes a first roofing material. In some embodiments, the first roofing material may be plywood, glass, cellulosic, a shingle, a glass mat, a fiberglass mat, an underlayment, a roofing membrane, a roof deck, a modified bitumen (MOD-BIT) substrate, a chimney, a polyisocyanurate (ISO) foam board, or any combination thereof.

In some embodiments, the roofing system includes a second roofing material. In some embodiments, the second roofing material may be plywood, glass, cellulosic, a shingle, a glass mat, a fiberglass mat, an underlayment, a roofing membrane, a roof deck, a modified bitumen (MOD-BIT) substrate, a chimney, a polyisocyanurate (ISO) foam board, or any combination thereof.

In some embodiments, the first roofing material and the second roofing material may be the same type of roofing material. In some embodiments the first roofing material and the second roofing material may be different types of roofing materials. In some embodiments, the first roofing material may be a shingle. In some embodiments, the second roofing material may be a shingle.

In some embodiments, the first roofing material includes a top surface and a bottom surface. In some embodiments, the second roofing material includes a top surface and a bottom surface. In some embodiments, the bottom surface of the second roofing substrate may be configured to attach to the top surface of the first roofing material. In some embodiments, the bottom surface of the first roofing material may be configured to attach to the top surface of the second roofing material.

In some embodiments, the roofing system comprises a roofing deck. In some embodiments, the bottom surface of the first roofing material may be secured to the roofing deck. In some embodiments, the bottom surface of the first roofing material may be attached to the roofing deck using adhesives, nails, staples, or any combination thereof.

For example, in some embodiments, the bottom surface of the first roofing material may include an adhesive. In some embodiments, the adhesive on the bottom surface of the first roofing material may be configured to secure the bottom surface of the first roofing material to the roofing deck. In some embodiments, the adhesive on the bottom surface of the first roofing material may be a self-adhering adhesive that may be configured to provide nail sealability, ice dam protection, leak barrier properties listed in ASTM D 1970, or any combination thereof. In some embodiments, the adhesive may comprise polyolefin polymer, poly-alpha-olefin (APAO/APO) polymer, Butyl, SIS, SBS, SEBS, SBR, ethylene vinyl acetate, poly vinyl acetate, acrylic adhesives, polyurethane, silane terminated polymer, asphaltic adhesives, hot melt adhesives, non-asphaltic adhesives, or any combination thereof.

In some embodiments, the top surface of the first roofing material may include a nail zone, which may be used to secure the first roofing material to the roofing deck. In some embodiments, the nail zone may be sized, shaped, and/or configured as described in U.S. patent application Ser. No. 16/533,032, the entire contents of which are incorporated by reference in their entirety.

In some embodiments, the nail zone includes a length and a width. In some embodiments, the width of the nail zone may be from 0.5" to 5", from 0.5" to 4.5", from 0.5" to 4", from 0.5" to 3.5", from 0.5" to 3", from 0.5" to 2.5", from 0.5" to 2", from 0.5" to 1.5", or from 0.5" to 1".

In some embodiments, the nail zone may have a width from 0.5" to 5", from 1" to 5", from 1.5" to 5", from 2" to 5", from 2.5" to 5", from 3" to 5", from 3.5" to 5", from 4" to 5", or from 4.5" to 5".

In some embodiments, the nail zone may have a width from 0.5" to 5", from 1" to 4.5", from 1.5" to 4", from 2" to 3.5", or from 2.5" to 3".

In some embodiments, the roofing system may include at least one fastener in the nail zone. In some embodiments, the at least one fastener may be a nail, a staple, a screw or any combination thereof. In some embodiments, the fastener may include a top portion. For example, in some embodiments, the at least one fastener may include at least one nail. In some embodiments, the at least one nail may include a nail head.

In some embodiments, the top surface of the first roofing material may be configured to attach to the bottom surface of the second roofing material. In some embodiments, the top surface of the first roofing material comprises fines. In some embodiments, the top surface of the first roofing material and the bottom surface of the first roofing material comprise fines. In some embodiment, the nail zone on the top surface of the first roofing material comprise a plurality of fines.

In some embodiments, the bottom surface of the second roofing material may be configured to attach to the top surface of the first roofing material. In some embodiments, the bottom surface of the second roofing material comprises a plurality of fines. In some embodiments, the top surface of the second roofing material and the bottom surface of the second roofing material comprise a plurality of fines. In some embodiments, the nail zone on the top surface of the second roofing material comprises a plurality of fines.

In some embodiments, the adhesive may be a patterned adhesive. In some embodiments, the patterned adhesive may be configured to directly contact the nail zone on the top surface of the first roofing material and the bottom surface of the second roofing material. In some embodiments, the adhesive may directly contact at least a portion of the plurality of fines on the bottom surface of the second roofing material. In some embodiments, the adhesive on the bottom surface of the second roofing material may be fiberized adhesive.

In some embodiments, the adhesive may be applied to the bottom surface of the second roofing material via coating, rolling, die coating, lamination, extrusion, spraying, fiberized spraying or any combination thereof. For example, in some embodiments, the adhesive may be applied using a fiberized spray according to the methods described in U.S. Pat. Nos. 5,903,540, 5,882,573, and 5,904,298, the entire contents of each of which are incorporated by reference herein in their entireties.

In some embodiments, the adhesive may be applied to a location on the bottom surface of the second roofing material so that when the bottom surface of the second roofing material overlaps the top surface of the first roofing material, the adhesive directly contacts at least a portion of the nail zone on the top surface of the first roofing material. In some embodiments, the adhesive may be applied to a location on the bottom surface of the second roofing material so that when the bottom surface of the second roofing material overlaps the top surface of the first roofing material, the adhesive directly contacts at least a portion of the plurality of fines in the nail zone on the top surface of the first roofing material. In some embodiments, the adhesive may be applied to a location on the bottom surface of the second roofing material so that when the bottom surface of the second roofing material overlaps the top surface of the first roofing material, the adhesive overlaps the top portion of the fastener in the nail zone and secures the top portion of the fastener between the nail zone on the top surface of the first roofing material and the adhesive on the bottom surface of the second roofing material.

In some embodiments, the adhesive on the bottom surface of the second roofing material includes a length and a width. In some embodiments. The width of the adhesive on the bottom surface of the second roofing material may be from 0.25" to 4", from 0.25" to 3.75", from 0.25" to 3.5", from 0.25" to 3.25", from 0.25" to 3", from 0.25" to 2.75", from 0.25" to 2.5", from 0.25" to 2.25", from 0.25" to 2", from 0.25" to 1.75", from 0.25" to 1.5", from 0.25" to 1.25", from 0.25" to 1", from 0.25" to 0.75", or from 0.25" to 0.5".

In some embodiments, the width of the adhesive on the bottom surface of the second roofing material may be from 0.25" to 4", from 0.5" to 4", from 0.75" to 4", from 1" to 4", from 1.25" to 4", from 1.5" to 4", from 1.75" to 4" from 2" to 4" from 2.25" to 4" from 2.5" to 4" from 2.75" to 4" from 3" to 4" from 3.25" to 4" from 3.5" to 4", or from 3.75" to 4".

In some embodiments, the width of the adhesive on the bottom surface of the second roofing material may be from 0.25" to 4", from 0.5" to 3.75", from 0.75" to 3.5", from 1" to 3.25", from 1.25" to 3", from 1.5" to 2.75", from 1.75" to 2.5", or from 2" to 2.25".

In some embodiments, the width of the nail zone on the top surface of the first roofing material may be the same as the width of the adhesive on the bottom surface of the second roofing material. In some embodiments, the width of the nail zone on the top surface of the first roofing material may be greater than the width of the adhesive on the bottom surface of the second roofing material. In some embodiments, the width of the nail zone on the top surface of the first roofing material may be from 0% to 50%, from 0% to 40%, from 0% to 30% from 0% to 20%, or from 0% to 10% greater than the width of the adhesive on the bottom surface of the second roofing material. In some embodiments, the width of the nail zone on the top surface of the first roofing material may be from 0% to 50%, from 10% to 50%, from 20% to 50% from 30% to 50%, or from 40% to 50% greater than the width of the adhesive on the bottom surface of the second roofing material. In some embodiments, the width of the nail zone on the top surface of the first roofing material may be from 0% to 50%, from 10% to 40%, or from 20% to 30% greater than the width of the adhesive on the bottom surface of the second roofing material.

In some embodiments, the adhesive on the bottom surface of the second roofing material may be configured to attach to the top surface of the first roofing material. In some embodiments, the adhesive may be a self-adhering adhesive that may be configured to provide nail sealability, ice dam protection, leak barrier properties listed in ASTM D 1970, or any combination thereof. In some embodiments, the adhesive on the bottom surface of the second roofing material may comprise polyolefin polymer, poly-alpha-olefin (APAO/APO) polymer, Butyl, SIS, SBS, SEBS, SBR, ethylene vinyl acetate, poly vinyl acetate, acrylic adhesives, polyurethane, silane terminated polymer, asphaltic adhesives, hot melt adhesives, non-asphaltic adhesives, or any combination thereof.

In some embodiments, the adhesive on the bottom surface of the second roofing material may comprise a thickness from 0.001" to 0.1", from 0.001" to 0.09", from 0.001" to 0.08", from 0.001" to 0.07", from 0.001" to 0.06", from 0.001" to 0.05", from 0.001" to 0.04", from 0.001" to 0.03" from 0.001" to 0.02", from 0.001" to 0.01", from 0.001" to 0.009", from 0.001" to 0.008", from 0.001" to 0.007", from 0.001" to 0.006", from 0.001" to 0.005", from 0.001" to 0.004", from 0.001" to 0.003", or from 0.001" to 0.002".

In some embodiments, the adhesive on the bottom surface of the second roofing material may comprise a thickness from 0.001" to 0.1", from 0.002" to 0.1", from 0.003" to 0.1", from 0.004" to 0.1", from 0.005" to 0.1", from 0.006" to 0.1", from 0.007" to 0.1", from 0.008" to 0.1" from 0.009" to 0.1", from 0.01" to 0.1", from 0.02" to 0.1", from 0.03" to 0.1", from 0.04" to 0.1", from 0.05" to 0.1", from 0.06" to 0.1", from 0.07" to 0.1", from 0.08" to 0.1", or from 0.09" to 0.1".

In some embodiments, the adhesive on the bottom surface of the second roofing material may comprise a thickness from 0.001" to 0.1", from 0.002" to 0.09", from 0.003" to 0.08", from 0.004" to 0.07", from 0.005" to 0.06", from 0.006" to 0.05", from 0.007" to 0.04", from 0.008" to 0.03", or from 0.009" to 0.02".

In some embodiments, the adhesive on the bottom surface of the second roofing material may comprise a viscosity from 100 cp to 200,000 cp, from 1000 cp to 200,000 cp, from 5000 cp to 200,000 cp, from 10,000 cp to 200,000 cp, from 15,000 cp to 200,000 cp, from 20,000 cp to 200,000 cp, from 25,000 cp to 200,000 cp, from 30,000 cp to 200,000 cp, from 35,000 cp to 200,000 cp, from 40,000 cp to 200,000 cp, from 45,000 cp to 200,000 cp, from 50,000 cp to 200,000 cp, from 55,000 cp to 200,000 cp, from 60,000 cp to 200,000 cp, from 65,000 cp to 200,000 cp, from 70,000 cp to 200,000 cp, from 75,000 cp to 200,000 cp, from 80,000 cp to 200,000 cp, from 85,000 cp to 200,000 cp, from 90,000 cp to 200,000 cp, from 95,000 cp to 200,000 cp, from 100,000 cp to 200,000 cp, from 105,000 cp to 200,000 cp, from 110,000 cp to 200,000 cp, from 115,000 cp to 200,000 cp, from 120,000 cp to 200,000 cp, from 125,000 cp to 200,000 cp, from 130,000 cp to 200,000 cp, from 135,000 cp to 200,000 cp, from 140,000 cp to 200,000 cp, from 145,000 cp to 200,000 cp, from 150,000 cp to 200,000 cp, from 155,000 cp to 200,000 cp, from 160,000 cp to 200,000 cp, from 165,000 cp to 200,000 cp, from 170,000 cp to 200,000 cp, from 175,000 cp to 200,000 cp, from 180,000 cp to 200,000 cp, from 185,000 cp to 200,000 cp, from 190,000 cp to 200,000 cp, or from 195,000 cp to 200,000 cp.

In some embodiments, the adhesive on the bottom surface of the second roofing material may comprise a viscosity from 100 cp to 200,000 cp, from 100 cp to 195,000 cp, from 100 cp to 190,000 cp, from 100 cp to 185,000 cp, from 100 cp to 180,000 cp, from 100 cp to 175,000 cp, from 100 cp to 170,000 cp, from 100 cp to 165,000 cp, from 100 cp to 160,000 cp, from 100 cp to 155,000 cp, from 100 cp to 150,000 cp, from 100 cp to 145,000 cp, from 100 cp to 145,000 cp, from 100 cp to 140,000 cp, from 100 cp to 135,000 cp, from 100 cp to 130,000 cp, from 100 cp to 125,000 cp, from 100 cp to 120,000 cp, from 100 cp to 115,000 cp, from 100 cp to 100 cp, from 100 cp to 105,000 cp, from 100 cp to 100,000 cp, from 100 cp to 95,000 cp, from 100 cp to 90,000 cp, from 100 cp to 85,000 cp, from 100 cp to 80,000 cp, from 100 cp to 75,000 cp, from 100 cp to 70,000 cp, from 100 cp to 65,000 cp, from 100 cp to 60,000 cp, from 100 cp to 55,000 cp, from 100 cp to 50,000 cp, from 100 cp to 45,000 cp, from 100 cp to 40,000 cp, from 100 cp to 35,000 cp, from 100 cp to 30,000 cp, from 100 cp to 25,000 cp, from 100,000 cp to 20,000 cp, from 100 cp to 15,000 cp, from 100 cp to 10,000 cp, from 100 cp to 5,000 cp, or from 100 cp to 1,000 cp.

In some embodiments, the adhesive on the bottom surface of the second roofing material may comprise a viscosity from 100 cp to 200,000 cp, from 1000 cp to 195,000 cp, from 5000 cp to 190,000 cp, from 10,000 cp to 185,000 cp, from 15,000 cp to 180,000 cp, from 20,000 cp to 175,000 cp, from 25,000 cp to 170,000 cp, from 30,000 cp to 165,000 cp, from 35,000 cp to 160,000 cp, from 40,000 cp to 155,000 cp, from 45,000 cp to 150,000 cp, from 50,000 cp to 145,000 cp, from 55,000 cp to 140,000 cp, from 60,000 cp to 135,000 cp, from 65,000 cp to 130,000 cp, from 70,000 cp to 125,000 cp, from 75,000 cp to 120,000 cp, from 80,000 cp to 115,000 cp, from 85,000 cp to 110,000 cp, from 90,000 cp to 105,000 cp, or from 95,000 cp to 100,000 cp.

In some embodiments, the bottom surface of the second roofing material may comprise a first edge. In some embodiments, the adhesive on the bottom surface of the second roofing material may also comprise a first edge. In some embodiments a distance from the first edge of the adhesive on the bottom surface of the second roofing material to the first edge of the bottom surface of the second roofing material may be from 0" to 5", from 0" to 4", from 0" to 3", from 0" to 2", from 0" to 1", from 0" to 0.75", from 0" to 0.50", or from 0" to 0.25".

In some embodiments, a distance from the first edge of the adhesive on the bottom surface of the second roofing material to the first edge of the bottom surface of the second roofing material may be from 0" to 5", from 0.25" to 5", from 0.5" to 5", from 0.75" to 5", from 1" to 5", from 2" to 5", from 3" to 5", or from 4" to 5".

In some embodiments, a distance from the first edge of the adhesive on the bottom surface of the second roofing material to the first edge of the bottom surface of the second roofing material may be from 0" to 5", from 0.25" to 4", from 0.5" to 3", or from 0.75" to 2".

The present disclosure will now be described with reference to non-limiting exemplary embodiments depicted in FIGS. 1-3E.

FIG. 1 depicts an exemplary embodiment of a back surface 12 of a second roofing material 10. As shown in FIG. 1, a patterned adhesive 14 may be on back surface 12. In the exemplary embodiment of FIG. 1, the back surface 12 of the second roofing material 10 may include a first edge 12*a*, and the patterned adhesive 14 may include a first edge 14*a*. The first edge 14*a* of the patterned adhesive 14 may be spaced apart from the first edge 12*a* of the back surface 12 of the second roofing material 10 by a distance 13.

Figure 2:
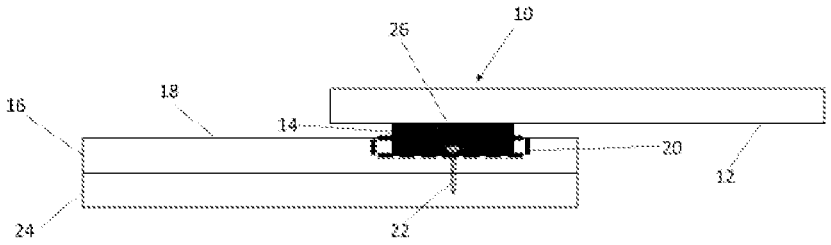
FIG. 2 is a cross-sectional view of a roofing system according to an exemplary embodiment of the present disclosure.
Figure 3A:
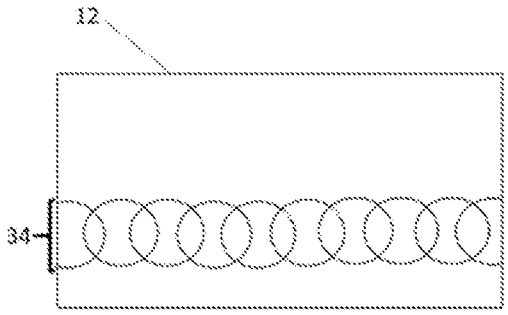
FIGS. 3A-3E are plane views of patterned adhesives on the bottom surfaces roofing materials according to exemplary embodiments of the present disclosure.
Figure 3B:
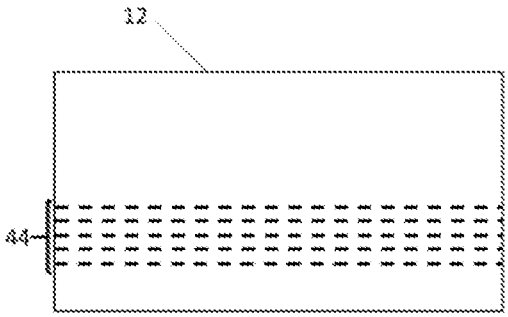
Figure 3C:
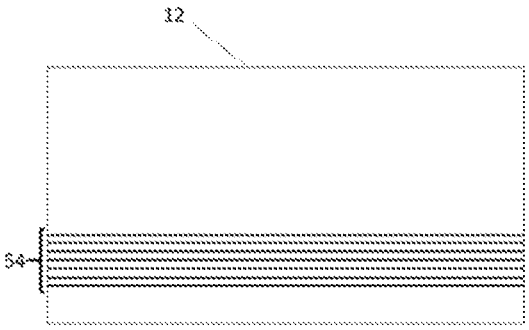
Figure 3D:
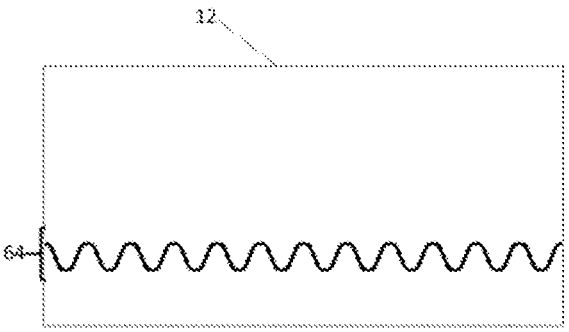
Figure 3E:
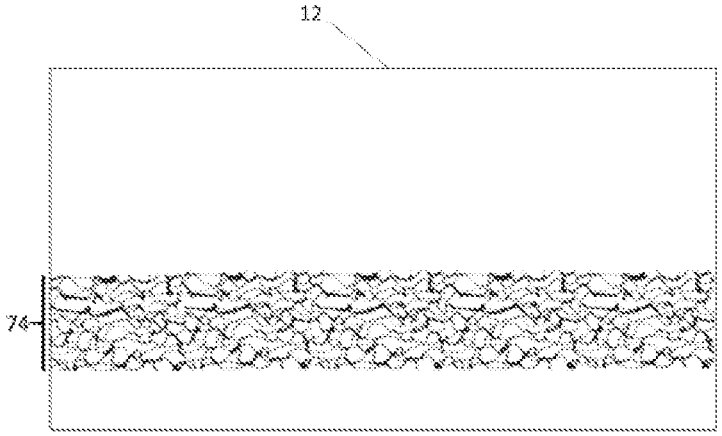

FIG. 2 depicts an exemplary embodiment of a cross-section of a roofing system including a first roofing material 16, a second roofing material 10, a patterned adhesive 14, and a roofing deck 24. In the exemplary embodiment of FIG.

2, the first roofing material 16 includes a top surface 18 with a nail zone 20. In addition, the nail zone 20 includes at least one nail 22, which may be used to secure the first roofing material 16 to the roofing deck 24. As shown in the exemplary embodiment of FIG. 2, the patterned adhesive 14 may directly contact at least a portion of the back surface 12 of the second roofing material 10 and may directly contact at least a portion of nail zone 20. A nail head 26 on the at least one nail 22 may be secured between the nail zone 20 and the patterned adhesive 14.

In the exemplary embodiment of FIG. 2, the back surface 12 of the second roofing material 10 may include a plurality of fines, and the nail zone 20 on the top surface 18 of the first roofing material 16 may include a plurality of fines. In the exemplary embodiment of FIG. 2, the patterned adhesive 14 may directly contact at least a portion of the plurality of fines on the back surface 12 of the second roofing material 10 and may directly contact at least a portion of the plurality of fines on the nail zone 20 on the top surface 18 of the first roofing material 16.

FIGS. 3A-3E depict exemplary embodiments of patterned adhesives on the back surface 12 of the second roofing material 10. In the exemplary embodiment of FIG. 3A, the patterned adhesive may comprise swirls 34. In the exemplary embodiment of FIG. 3B, the patterned adhesive may comprise dashes 44. In the exemplary embodiment of FIG. 3C, the patterned adhesive may comprise stripes 54. In the exemplary embodiment of FIG. 3D, the patterned adhesive may comprise sine waves 64. In the exemplary embodiment of FIG. 3E, the patterned adhesive may be randomized 74.

Variations, modifications and alterations to embodiments of the present disclosure described above will make themselves apparent to those skilled in the art. All such variations, modifications, alterations and the like are intended to fall within the spirit and scope of the present disclosure, limited solely by the appended claims.

While several embodiments of the present disclosure have been described, it is understood that these embodiments are illustrative only, and not restrictive, and that many modifications may become apparent to those of ordinary skill in the art. For example, all dimensions discussed herein are provided as examples only, and are intended to be illustrative and not restrictive.

Any feature or element that is positively identified in this description may also be specifically excluded as a feature or element of an embodiment of the present as defined in the claims.

The disclosure described herein may be practiced in the absence of any element or elements, limitation or limitations, which is not specifically disclosed herein. Thus, for example, in each instance herein, any of the terms "comprising," "consisting essentially of" and "consisting of" may be replaced with either of the other two terms, without altering their respective meanings as defined herein. The terms and expressions which have been employed are used as terms of description and not of limitation, and there is no intention in the use of such terms and expressions of excluding any equivalents of the features shown and described or portions thereof, but it is recognized that various modifications are possible within the scope of the disclosure.

What is claimed:

1. A roofing system comprising: a first roofing material comprising a top surface, wherein the top surface of the first roofing material comprises a nail zone, and wherein the nail zone comprises a plurality of fines; a second roofing material comprising: a bottom surface, wherein the bottom surface of the second roofing material comprises a plurality of fines; and a patterned adhesive, wherein the patterned adhesive directly contacts at least a portion of the plurality of fines on the bottom surface of the second roofing material without any intervening layer between the patterned adhesive and the plurality of fines on the bottom surface of the second roofing material, wherein the patterned adhesive directly contacts at least a portion of the plurality of fines in the nail zone on the top surface of the first roofing material without any intervening layer between the patterned adhesive and the plurality of fines in the nail zone of the first roofing material, and wherein the patterned adhesive comprises a swirl pattern.

2. The roofing system of claim 1, wherein the roofing system further comprises a roof deck, wherein the first roofing material further comprises a bottom surface, and wherein the bottom surface of the first roofing material is secured to the roof deck.

3. The roofing system of claim 2, wherein the bottom surface of the first roofing material is secured to the roof deck using an adhesive, a fastener, or any combination thereof.

4. The roofing system of claim 1, wherein the nail zone comprises at least one fastener.

5. The roofing system of claim 4, wherein the at least one fastener comprises a nail, and wherein the at least one nail comprises a nail head.

6. The roofing system of claim 5, wherein the patterned adhesive overlaps the nail head of the at least one nail to secure the nail head in the nail zone.

7. The roofing system of claim 1, wherein the first roofing material comprises a shingle, and wherein the second roofing material comprises a shingle.

8. The roofing system of claim 1, wherein the patterned adhesive comprises a fiberized adhesive.

9. The roofing system of claim 1, wherein the patterned adhesive includes a length and a width, wherein the nail zone includes a length and a width, and wherein the width of the nail zone is greater than the width of the patterned adhesive.

10. The roofing system of claim 9, wherein the width of the patterned adhesive is from 0.25" to 2".

11. The roofing system of claim 1, each of the plurality of fines of the first roofing material and the plurality of fines of the second roofing material comprises pieces of mica flakes, copper slag, coal slag, sand, talc, expanded clay, slate flour, powdered limestone, and silica dust.

12. A roofing system comprising: a first roofing material comprising a top surface, wherein the top surface of the first roofing material comprises a nail zone, and wherein the nail zone comprises a plurality of fines, and wherein the nail zone comprises at least one fastener, wherein the at least one fastener comprises a top portion;

a second roofing material comprising: a bottom surface, wherein the bottom surface of the second roofing material comprises a plurality of fines; and a patterned adhesive, wherein the patterned adhesive directly contacts at least a portion of the plurality of fines on the bottom surface of the second roofing material without any intervening layer between the patterned adhesive and the plurality of fines on the bottom surface of the second roofing material, wherein the patterned adhesive directly contacts at least a portion of the plurality of fines in the nail zone on the top surface of the first roofing material without any intervening layer between the patterned adhesive and the plurality of fines in the nail zone of the first roofing material, wherein the patterned adhesive overlaps the top portion of the at least one fastener to secure the top portion of the at least one fastener in the nail zone, and wherein the patterned adhesive comprises a swirl pattern.

13. The roofing system of claim 12, wherein the at least one fastener comprises a nail, and wherein the top portion of the at least one fastener comprises a nail head.

14. The roofing system of claim 12, wherein the patterned adhesive is a fiberized adhesive.

15. The roofing system of claim 12, wherein the patterned adhesive includes a length and a width, wherein the nail zone includes a length and a width, and wherein the width of the nail zone is greater than the width of the patterned adhesive.

16. The roofing system of claim 12, wherein the roofing system further comprises a roof deck, wherein the first roofing material further comprises a bottom surface, and wherein the bottom surface of the first roofing material is secured to the roof deck.

17. A method comprising: obtaining a first roofing material comprising a top surface, wherein the top surface of the first roofing material comprises a nail zone, and wherein the nail zone comprises a plurality of fines, and obtaining a second roofing material comprising: a bottom surface, wherein the bottom surface of the second roofing material comprises a plurality of fines; and a patterned adhesive, wherein the patterned adhesive directly contacts at least a portion of the plurality of fines on the bottom surface of the second roofing material without any intervening layer between the patterned adhesive and the plurality of fines on the bottom surface of the second roofing material, and attaching the bottom surface of the second roofing material to the top surface of the first roofing material so that the patterned adhesive directly contacts at least a portion of the plurality of fines in the nail zone on the top surface of the first roofing material without any intervening layer between the patterned adhesive and the plurality of fines in the nail zone of the first roofing material, and wherein the patterned adhesive comprises a swirl pattern.

18. The method of claim 17, wherein the first roofing material comprises a bottom surface, and wherein the method comprises attaching the bottom surface of the first roofing material to a roof deck.

19. The method of claim 18, wherein attaching the bottom surface of the first roofing material to the roof deck comprises inserting at least one fastener into the nail zone on the top surface of the first roofing material.

20. The method of claim 19, wherein the at least one fastener is a nail comprising a nail head, and wherein attaching the bottom surface of the second roofing material to the top surface of the first roofing material comprises positioning patterned adhesive over the nail head so as to secure the nail head in the nail zone.

21. The method of claim 17, wherein the patterned adhesive is a fiberized adhesive.

* * * * *